US008496504B2

(12) United States Patent
Ono et al.

(10) Patent No.: US 8,496,504 B2
(45) Date of Patent: Jul. 30, 2013

(54) CRIMP TERMINAL, TERMINAL-EQUIPPED ELECTRIC WIRE WITH THE CRIMP TERMINAL, AND METHODS FOR PRODUCING THEM

(75) Inventors: Junichi Ono, Yokkaichi (JP); Hiroki Hirai, Yokkaichi (JP); Tetsuji Tanaka, Yokkaichi (JP); Hiroki Shimoda, Yokkaichi (JP); Takuji Otsuka, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 151 days.

(21) Appl. No.: 12/990,589

(22) PCT Filed: Jun. 29, 2009

(86) PCT No.: PCT/JP2009/061839
§ 371 (c)(1),
(2), (4) Date: Nov. 1, 2010

(87) PCT Pub. No.: WO2010/001851
PCT Pub. Date: Jan. 7, 2010

(65) Prior Publication Data

US 2011/0045713 A1 Feb. 24, 2011

(30) Foreign Application Priority Data

Jun. 30, 2008 (JP) ..... 2008-169837

(51) Int. Cl.
*H01R 4/10* (2006.01)

(52) U.S. Cl.
USPC ..... 439/877

(58) Field of Classification Search
USPC ..... 439/877, 886; 29/863, 874, 871, 29/882; 428/615, 647, 674; 419/8
See application file for complete search history.

(56) References Cited

U.S. PATENT DOCUMENTS 5,028,492 A * 7/1991 Guenin ..... 428/614
5,129,143 A * 7/1992 Wei et al. ..... 29/885

(Continued)

FOREIGN PATENT DOCUMENTS

CN 1591979 A 3/2005
EP 1 503 454 A1 2/2005

(Continued)

OTHER PUBLICATIONS

International Search Report in International Application No. PCT/JP2009/061839; dated Aug. 25, 2009 (with English-language translation).

*Primary Examiner* — Alexander Gilman
(74) *Attorney, Agent, or Firm* — Oliff & Berridge, PLC

(57) ABSTRACT

Provided is a crimp terminal designed to be crimped onto an end portion of an electric wire to form a terminal-equipped electric wire, achieving both of ensuring mechanical strength of the terminal-equipped electric wire and reducing a contact resistance between the electric wire and the crimp terminal. The crimp terminal comprises an electric contact section and an electric-wire crimp section to be crimped onto a conductor in the end portion of the electric wire, the crimp terminal being formed of a metal plate which has a copper-containing plate body and a tin-plating layer covering a surface of the plate body. In the crimp terminal, the tin-plating layer has a smaller thickness in a crimp surface region where the electric-wire crimp section is to make contact with the end portion of the electric wire is less than that in an electrical contact surface region where the electric contact section is to make contact with a counterpart terminal.

13 Claims, 6 Drawing Sheets

U.S. PATENT DOCUMENTS

| | | | | | |
|---|---|---|---|---|---|
| 5,141,702 | A | * | 8/1992 | Guenin et al. | 419/8 |
| 5,235,743 | A | * | 8/1993 | Endo et al. | 29/885 |
| 5,307,562 | A | * | 5/1994 | Denlinger et al. | 29/882 |
| 5,322,575 | A | * | 6/1994 | Endo et al. | 148/554 |
| 5,351,396 | A | * | 10/1994 | Sawada et al. | 29/885 |
| 5,499,448 | A | * | 3/1996 | Tournier et al. | 29/863 |
| 5,780,172 | A | * | 7/1998 | Fister et al. | 428/647 |
| 5,849,424 | A | * | 12/1998 | Sugawara et al. | 428/674 |
| 5,916,695 | A | * | 6/1999 | Fister et al. | 428/647 |
| 6,183,885 | B1 | * | 2/2001 | Nakamura et al. | 428/647 |
| 6,451,449 | B2 | * | 9/2002 | Asakura et al. | 428/615 |
| 6,770,383 | B2 | * | 8/2004 | Tanaka et al. | 428/646 |
| 7,024,767 | B1 | * | 4/2006 | Lai | 29/874 |
| 7,174,626 | B2 | * | 2/2007 | Kwoka et al. | 29/827 |
| 7,306,495 | B2 | * | 12/2007 | Hashimoto et al. | 439/877 |
| 2001/0008709 | A1 | | 7/2001 | Asakura et al. | |
| 2005/0026515 | A1 | * | 2/2005 | Hashimoto et al. | 439/877 |

FOREIGN PATENT DOCUMENTS

| | | | |
|---|---|---|---|
| EP | 2 224 556 | A1 | 9/2010 |
| JP | A-63-121693 | | 5/1988 |
| JP | A-10-134869 | | 5/1998 |
| JP | A-11-214050 | | 6/1999 |
| JP | A-2005-050736 | | 2/2005 |
| JP | A-2005-174896 | | 6/2005 |
| JP | A-2009-152051 | | 7/2009 |
| JP | A-2009-152052 | | 7/2009 |
| WO | WO 2009/081798 | A1 | 7/2009 |
| WO | WO 2009/081799 | A1 | 7/2009 |

* cited by examiner

CRIMP TERMINAL, TERMINAL-EQUIPPED ELECTRIC WIRE WITH THE CRIMP TERMINAL, AND METHODS FOR PRODUCING THEM

BACKGROUND OF THE INVENTION

1. Field of the Invention

The present invention relates to a crimp terminal adapted to be crimped onto an end portion of an electric wire to be wired in an automobile or the like, a terminal-equipped electric wire having the crimp terminal, and production methods for them.

2. Description of the Related Art

As means for attachment of a terminal to an end portion of an insulated electric wire, has been widely used a crimp technique as disclosed, for example, in Patent Document 1: JP 2005-50736A. The crimp is performed by crimping an electric-wire crimp section (e.g., conductor barrel) preliminarily formed in the terminal onto an end portion of a conductor of the insulated electric wire.

However, the above crimp technique involves difficulty in setting a degree of deformation of the electric-wire crimp section. For example, in the case where the electric-wire crimp section is a conductor barrel, it is difficult to set a crimp height thereof. Setting the crimp height to a small value, while having an advantage of reduction in a contact resistance between the conductor barrel and the conductor of the electric wire, involves a high reduction rate of a cross-sectional area of the conductor, which causes a trouble of deterioration in mechanical strength, particularly, in tensile strength against shock load, (strength of the crimp terminal to hold the electric wire). On contrast, setting the crimp height to a large value, while allowing the mechanical strength to be maintained at a high level, involves a trouble of an increase in the contact resistance between the conductor barrel and the conductor of the electric wire.

Especially, in recent years, there has been studied an use of aluminum or an aluminum alloy as a material for a conductor forming an electric wire; the use particularly involves a difficult set of the crimp height. Specifically, the aluminum or aluminum alloy has a surface which is likely to be loaned with an oxide film in which increases the contact resistance; setting the crimp height to a small value enough to sufficiently reduce the contact resistance irrespective of the formation of the oxide film, makes it becomes difficult to sufficiently ensure the mechanical strength.

As means for solving the above problem, Patent Document 1: JP 2005-507396A discloses a technique of simultaneously forming a large-crimp height portion and a small-crimp height portion in the conductor barrel. In this technique, the large-crimp height portion is formed in a distal-end region of the conductor to contribute to the maintained mechanical strength, while the small-crimp height portion contributes to the reduced contact resistance. However, it is difficult to sufficiently ensure the strength of the terminal while forming a stepped portion corresponding to a difference between the two crimp heights. In other words, to ensure sufficient strength of the terminal, there is allowed only a significantly limited difference to be given between the different crimp heights.

PRIOR ART DOCUMENT

Patent Document

Patent Document 1: JP 2005-50736A

SUMMARY OF THE INVENTION

In view of the above circumstances, it is an object of the present invention to provide a crimp terminal capable of achieving both of ensuring mechanical strength of an terminal-equipped electric wire having the crimp terminal and reducing a contact resistance between an electric wire and the crimp terminal without giving a significant height difference to a electric-wire crimp section of the crimp terminal, and to provide a terminal-equipped electric wire having the crimp terminal, and methods for producing them.

To solve the above problem, the inventors focused on a structure of a metal plate forming a crimp terminal, particularly, the existence of a tin-plating layer forming a surface of the metal plate.

Typically, the metal plate comprises a plate body made of copper or a copper alloy, and the tin-plating layer covering a surface of the plate body. The tin-plating layer has a key roll in stabilizing contact with a counterpart terminal. Specifically, it covers the surface of the plate body to prevent a copper oxide film which increases the contact resistance from being formed in the surface. Although the tin-plating layer also has a surface where a tin oxide film is formed, this tin oxide film is likely to break easily, as compared with the copper oxide film, thus having little effect on the contact resistance.

However, it has been found that the tin-plating layer, while having the above advantage, could be a factor hindering a reduction in contact resistance between the crimp terminal and a conductor in an end portion of an electric wire onto which the crimp terminal is crimped. This would be because the tin-plating layer has a characteristic of being more slippery (than copper or a copper alloy) against the conductor of the electric wire, and the slip hinders adhesion between the crimp terminal and the conductor by press contact with each other to inhibit a reduction in the contact resistance based on the adhesion.

The present invention is achieved based on this point of view, providing a crimp terminal which comprises an electric contact section to be fitted with a counterpart terminal to be electrically connected thereto, and an electric-wire crimp section to be crimped onto an end portion of an electric wire having a conductor exposed in the end portion, wherein the crimp terminal is formed of a metal plate having a copper-containing plate body and a tin-plating layer covering a surface of the plate body, the tin-plating layer having a smaller thickness in a crimp surface region where the electric-wire crimp section is to make contact with the end portion of the electric wire than a thickness in an electrical contact surface region where the electric contact section is to make contact with a counterpart terminal.

In the electric contact section of this crimp terminal, the existence of the tin-plating layer in the electric contact surface region enables adequate electric contact with the counterpart terminal to be ensured, as with a conventional crimp terminal, while, in the electric-wire crimp section, the smaller thickness of the tin-plating layer in the crimp surface region than that in the electric contact surface region makes it possible to provide good adhesion between the crimp surface region and the conductor of the electric wire to reduce a contact resistance therebetween, as compared with a conventional crimp terminal where the thickness of the tin-plating layer in the crimp surface region is equal to that in the electric contact surface region. In short, the contact resistance is allowed to be maintained at a low level not involving an increase in a degree of deformation for crimping of the electric-wire crimp section (for example, without lowering a crimp height of a conductor barrel).

DESCRIPTION OF EMBODIMENTS

With reference to the drawings, a preferred embodiment of the present invention will be described.

Figure 1:
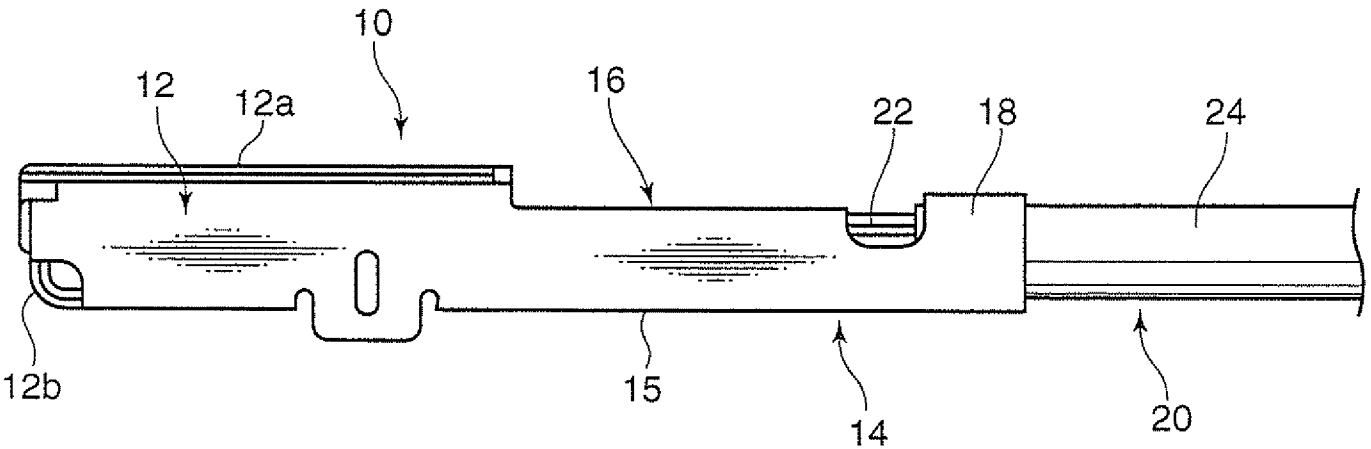
FIG. 1 is a side view of a terminal-equipped electric wire according to an embodiment of the present invention.

FIG. 1 shows a terminal-equipped electric wire according to an embodiment of the present invention. This terminal-equipped electric wire comprises an electric wire 20 and a crimp terminal 10, and is produced through a step of producing the crimp terminal 10 and a step of crimping the crimp terminal 10 onto an end portion of the electric wire 20.

The electric wire 20 comprises a conductor 22 formed of a plurality of element wires and an insulation cover 24 covering the conductor 22 from an outside thereof, the insulation cover 24 being partially removed in an end portion of the electric wire to expose the conductor 22. Onto the end portion of the electric wire 20 is crimped the crimp terminal 10. The conductor 22 is made of a material not particularly limited; there may be used a copper, a copper alloy and various other commonly-used electrical conductive materials. Meanwhile, the present invention is particularly usefully applied to one made of a material, such as aluminum or an aluminum ally, which has a surface where an oxide film causing an increase in contact resistance is likely to be formed.

Similarly to conventional terminals, the crimp terminal 10 is formed of a single metal plate subjected to bending, having an electric contact section 12 and an electric-wire crimp section 14 on respective ones of front and rear sides thereof.

The electric contact section 12 according to this embodiment is a female type, which has a box-shaped portion 12*a* into which a male-type terminal (counterpart terminal) can be inserted and a contact spring piece 12*b* folded back inwardly from a front side of the box-shaped portion 12*a*, wherein an electric contact section of the male-type terminal can be fittingly inserted between the contact spring piece 12*b* and a back surface of a top wall of the box-shaped portion 12*a*. There are thus included respective electric contact surface regions contactable with the counterpart terminal, in an upper surface of the contact spring piece 12*b*, and the back surface of the top wall of the box-shaped portion 12*a*.

The crimp terminal according to the present invention is permitted to be a male-type terminal with a tab-shaped electric contact section.

The electric-wire crimp section 14 comprises a basal portion 15 extending rearwardly from the electrical contact section 12 along an axial direction thereof, a pair of right and left conductor barrels 16 extending from the basal portion 15 in a direction crossing the axial direction (in FIG. 1, in a direction perpendicular to the axial direction), and a pair of right and left insulation barrels 18 extending approximately in parallel with the conductor barrels 16.

Each of the conductor barrels 16 has a U shape viewed frontward from the side of a rear end of the crimp terminal, in a stage before the bending for crimp, and the insulation barrels 18 has a similar shape. Through the bending, the conductor barrels 16 are crimped onto the conductor 22 exposed in the end portion of the electric wire 20 so as to enfold the conductor 22. Similarly, the insulation barrels 18 are crimped, through the bending, onto the insulation cover 24 to enfold the insulation cover 24, at a position just rearward of the exposed portion of the conductor 22. Thus, the basal portion 15 and the conductor barrels 16 have inner surfaces each serving as a crimp surface to make press contact with the conductor 22 exposed in the end portion of the electric wire 20.

The metal plate forming the crimp terminal 10 has a plate body containing copper and a tin-plating layer formed on the surface of the plate body. The plate body may be formed of only a substrate made of copper or a copper alloy (e.g., brass or any other heat-resistant copper alloy), or may comprise a zinc-containing substrate and a barrier layer with a given thickness formed on a surface of the substrate to prevent zinc contained in the substrate from being diffused in the tin-plating layer. The barrier layer is, for example, preferably made of copper or an copper alloy (e.g., brass) to have a thickness of about 0.5 to 1 μm.

The crimp terminal 10 has a feature that its tin-plating layer has a smaller thickness in a crimp surface region where the electric-wire crimp section 14 is to make contact with the end portion of the electric wire 20 than a thickness in an electrical contact surface region where the electric contact section 12 is to make contact with the counterpart terminal. Thus setting the thickness of the tin-plating layer allows both of ensuring adequate electric contact between the electric contact section 12 and the counterpart terminal and reducing a contact resistance between the electric-wire crimp section 14 and the conductor 22 in the end portion of the electric wire 20 to be achieved.

Specifically, in the electric contact section 12, sufficiently ensuring the thickness of the tin-plating layer softer than the copper alloy forming the plate body stabilizes a contact state between the electric contact section 12 and the electric contact section of the counterpart terminal. Specifically, a minimum of the thickness of the tin-plating layer in the electric contact surface region of the electric contact section 12 is preferably 0.2 μm or more, and more preferably 1 μm or more. Meanwhile, since the excessively great thickness of the tin-plating layer involves an increased resistance against the fitting between the terminals (insertion resistance), the preferable thickness of the tin-plating layer is 10 μm or less.

As to the electric-wire crimp section 14, setting the thickness of the tin-plating layer in the crimp surface region of the electric-wire crimp section 14 smaller than that in the electrical contact surface region suppresses a contact resistance increase due to the tin-plating layer. Specifically, the tin-plating layer in the crimp surface region, having such a small friction coefficient as to be slippery with respect to the counterpart conductor 22 with which the crimp surface region comes press contact, probably hinders adhesion between the crimp surface region and the conductor 22 based on resulting frictional heat and inhibits a reduction of the contact resistance based on the adhesion. Therefore, making the tin-plating layer in the crimp surface region thin to reduce its influence allows the contact resistance to be reduced without significantly lowering the crimp height of the conductor barrels 16.

From this point of view, the thickness of the tin-plating layer in the crimp surface region is preferably small, 1 μm or less, more preferably 0.6 μm or less, furthermore preferably 0.4 μm or less, still furthermore preferably 0.2 μm or less. Moreover, in the case of no requirement of considering an influence of a copper oxide film formation in the crimp surface region, the thickness of the tin-plating layer in the crimp surface region is permitted to be 0 μm so as to expose the plate body. In either case, the contact resistance between the crimp surface region and the conductor 22 in the end portion of the electric wire 20 is reduced corresponding to the thickness differential from the tin-plating layer in the electrical contact surface region to that in the crimp surface region.

To produce the crimp terminal 10, useful is a method which comprises a metal-plate producing step of producing a metal plate including a tin-plating layer of a thickness set in the above manner, and a terminal forming step of punching out an original terminal plate from the metal plate and bending the original terminal plate to form the crimp terminal 10. The metal plate can be produced, for example, by the following method A or B.

Method A: This method comprises a plating step of forming a tin-plating layer on a surface of a plate body (a portion made of copper or an copper alloy) which forms the metal plate, the plating step including a first plating sub-step of forming a tin-plating layer over an entire surface of the plate body and a second plating sub-step of forming an additional tin-plating layer, in a specific area including the electric contact surface region and excluding the crimp surface region, on the tin-plating layer formed in the first plating sub-step. Performing the second plating sub-step only on the specific region enables the thickness of the tin-plating layer in the specific region to be greater than that in the other region, that is, enables the thickness of the tin-plating layer in the crimp surface region to be smaller than that in the electric contact surface region.

Figure 2:
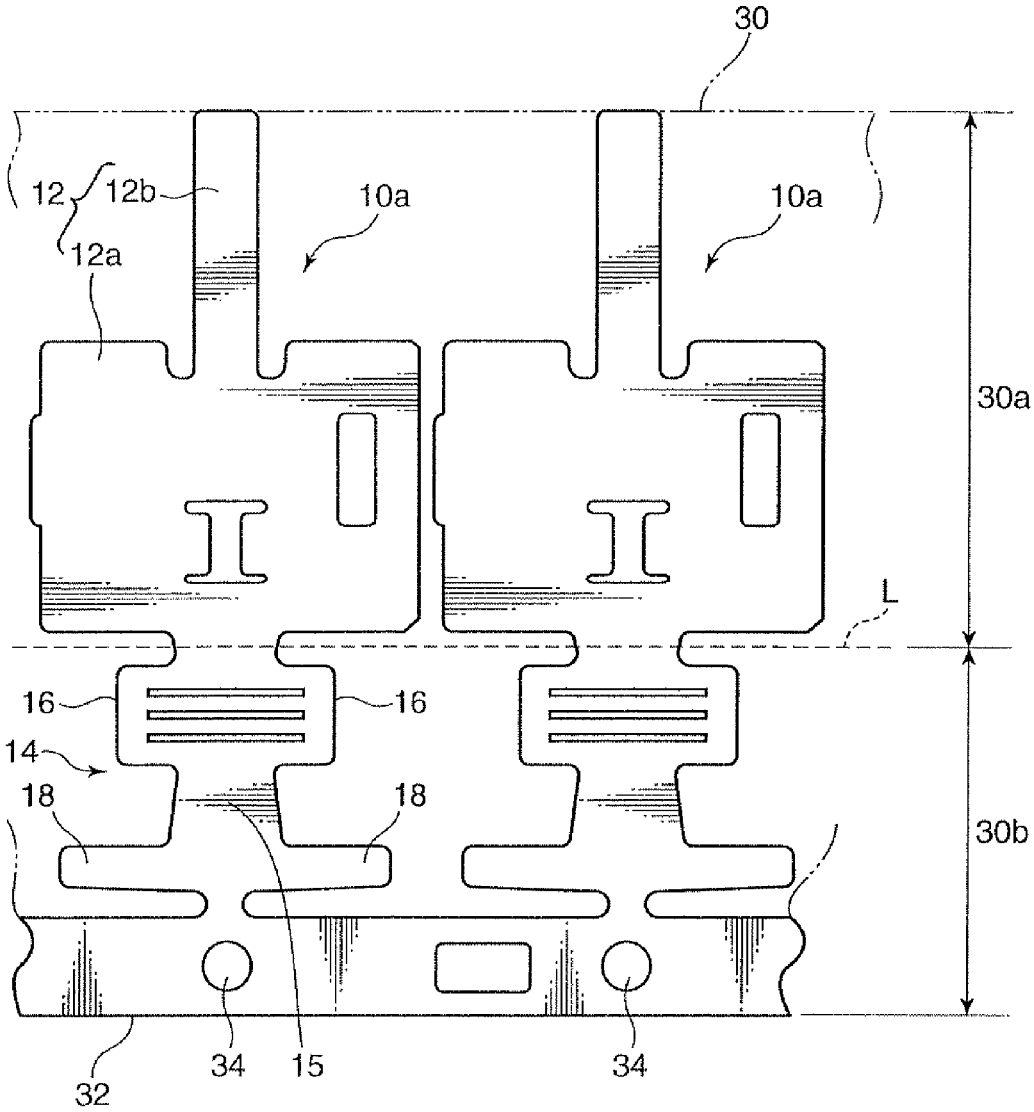
FIG. 2 is a top plan view of a metal strip from which an original terminal plate of the crimp terminal is to be punched out.

More specific description will be made with reference to FIGS. 2 to 4. Shown in FIG. 2 is a metal strip 30 formed of the above metal plate, from which a lot of original plates for the crimp terminals 10 are punched out. Specifically, from the metal strip 30, as shown in FIG. 2, punched out are a plurality of original terminal plates each having a shape corresponding to that of the crimp terminal 10 in development view and a bridge 32 extending longitudinally of the metal strip 30 so as to connect respective rear ends of the original terminal plates arranged longitudinally of the metal strip 30. Following bending of each of the original terminal plates in a die to form the crimp terminal 10, the formed crimp terminal 10 is cut off from the bridge 32. The bridge 32 is formed with a positioning hole 43 to be positioned the metal strip in the die.

The broken line L in FIG. 2 indicates a boundary between a front region 30*a* from which the electric contact section 12 of the crimp terminal 10 is to be punched out and a rear region 30*b* from which the electric-wire crimp section 14 of the crimp terminal 10 and the bridge 32 are to be punched out. The first plating sub-step is performed over an entire surface of the plate body comprised in the metal strip 30, and thereafter the second plating sub-step is performed, for example, only in the front region 30*a*; thus, there can be finally produced a crimp terminal 10 in which the tin-plating layer in the electric-wire crimp section 14 has a thickness smaller than that in the electric contact section 12.

Figure 3:
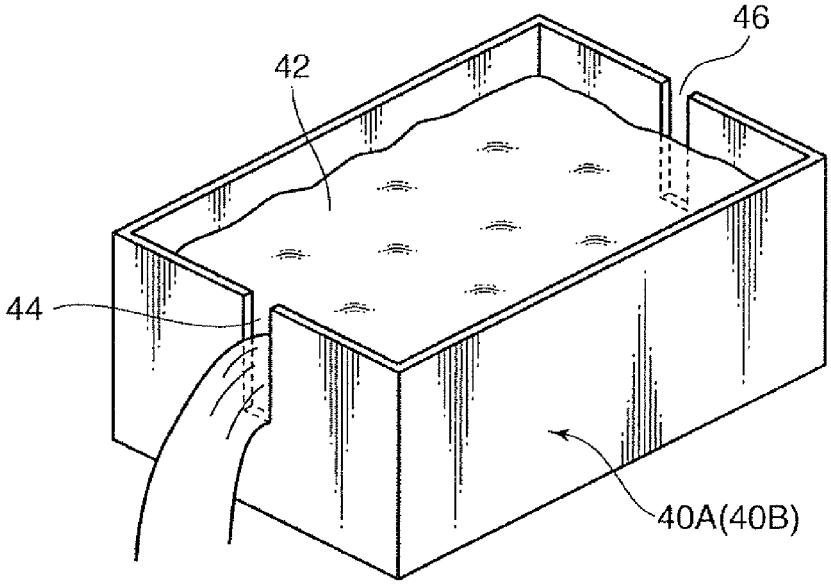
FIG. 3 is a perspective view showing a plating bath container for subjecting the metal strip to plating.
Figure 4:
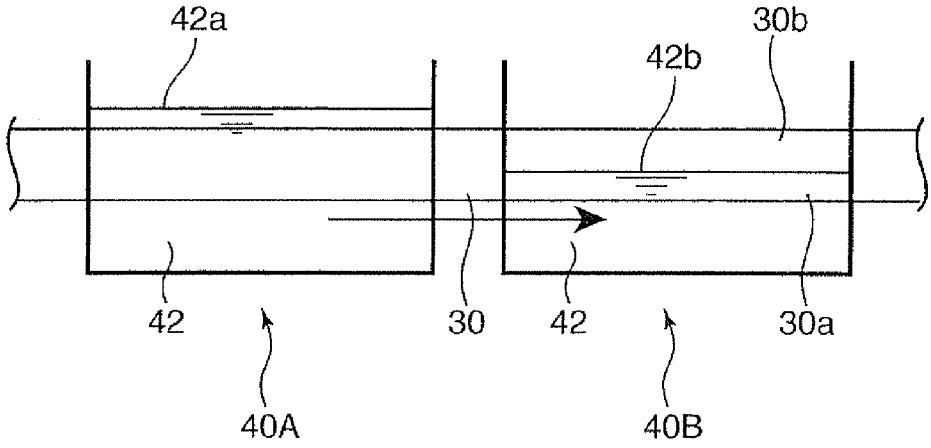
FIG. 4 is a diagram showing the plating process using the plating bath container.

This plating step may be performed, for example, by use of a first plating bath container 40A and a second bath container 40B shown in FIGS. 3 and 4. As shown in FIG. 3, each of the plating bath containers 40A and 40B is a tank opened upwardly, having opposite sidewalls each formed with a slit 44 opened upwardly. Each of the slits 44 has a shape of allowing the metal strip 30 on which the tin-plating layer has not been formed yet (that is, consisting only of the plate body) to pass the slit 44, in a vertically-standing posture of the metal strip 30. The plating bath containers 40A and 40B are so arranged as to align both of the slits 44 of the plating bath container 40A and both of the slits 44 of the plating bath container 40B in a straight line.

Into each of the plating bath containers 40A and 40B, a plating liquid 42 consisting of molten are poured and continuously supplied at a speed corresponding to a flow out speed of the plating liquid 42 from the slits 44, thereby keeping a liquid level of the plating bath 42 at a given height position above a lower end of each of the slits 44.

According to the plating bath containers 40A and 40B, the first plating sub-step and the second plating sub-step can be continuously and efficiently performed by moving the metal strip 30 to pass through the first plating bath container 40A at such a height position that the entire metal strip 30 is immersed in the plating bath 42 in the first plating bath container 40A and pass through the second plating bath container 40B at such a height position that only the front region 30*a* thereof is immersed in the plating bath 42 in the second plating bath container 40B, while keeping a liquid level 42*a* of the plating bath 42 in the first plating bath container 40A at a position higher than a liquid level 42*b* of the plating bath 42 in the second plating bath container 40B as shown in FIG. 4.

There is not limited a method for performing the first and second plating sub-steps to the above method which includes giving a height difference between the liquid levels 42*a* and 42*b*. For example, only the front region 30*a* can be subjected to the second plating sub-step also by moving the metal strip 30 to pass through the plating bath 42 in the second plating bath container 40B while masking the rear region 30*b*. Besides, the boundary between the region 30*a* and 30*b* may be appropriately changed. Required is only a condition that the area where the second plating sub-step is performed includes the electric contact surface region while not including the crimp surface region.

The second plating sub-step may be followed by the first plating sub-step. Specifically, it is permitted that only the front region 30*a* be subjected to tin-plating and thereafter the entire surface of the metal strip 30*a* be subjected to additional tin-plating.

Alternatively, the plating step may comprise a first plating sub-step of forming a tin-plating layer on the plate body of the metal plate in an area including the electric contact surface region and excluding the crimp surface region, and a second plating sub-step of, before or after the first plating sub-step, forming a fin-plating layer having a thickness smaller than that of the tin-plating layer formed or to be formed in the first plating sub-step, on the plate body in an area including the crimp surface region and excluding the electric contact surface region. For example, it is permitted that: only the front region 30*a* of the metal strip 30 be immersed in a plating bath 42 of tin to form a first tin-plating layer thereon and thereafter, the metal strip 30 turned 180 degrees, the remaining rear region 30*b* be immersed in the plating bath 42 to form thereon a second tin-plating layer having a thickness smaller than that of the first tin-plating layer.

Method B: This method comprises a plating step of forming a tin-plating layer on a surface of the plate body (a portion made of copper or an copper alloy) of the metal plate, and a heat treatment step of heating the tin-plating layer only in an area including the crimp surface region and excluding the electric contact surface region to bring at least a part of the tin-plating layer into a solid solution with the plate body involving a thickness reduction of the tin-plating layer.

Figure 5:
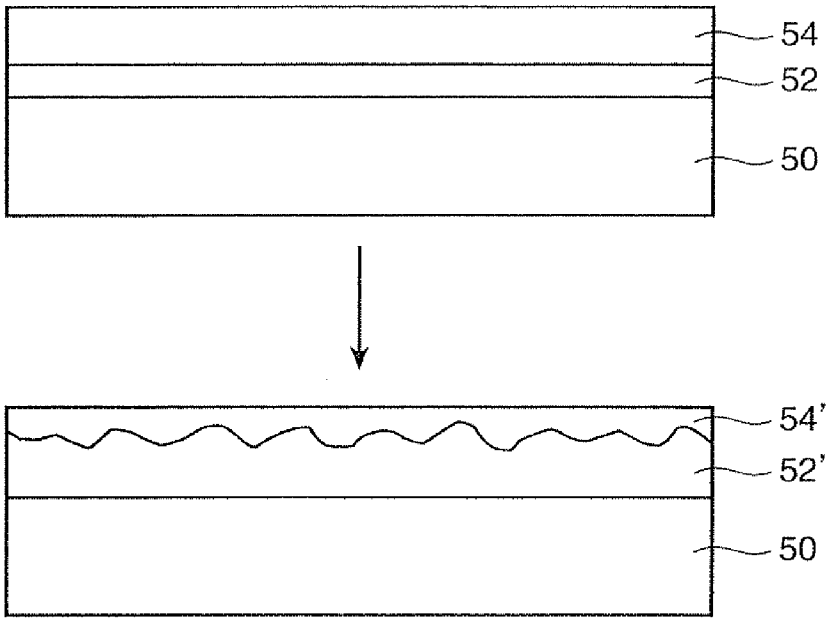
FIG. 5 is a diagram showing a change in layers caused by subjecting the metal strip to a heat treatment in a heat treatment step.

FIG. 5 shows an example of a laminated structure of the metal plate after the plating step. This structure comprises a substrate 50 made of a copper alloy (e.g., brass or heat-resistant copper alloy), a barrier layer 52 made of copper, and a tin-plating layer 54, which layers are laminated in this order. The barrier layer 52, which makes up the plate body in cooperation with the substrate 50 and has a roll in preventing zinc contained in the substrate 50 from being diffused into the tin-plating layer 54, may be omitted on a case-by-case basis.

Upon a heating treatment of such a surface of the metal plate under an appropriate condition, a part of tin contained in the tin-plating layer 54 is brought into a solid solution with copper diffused from the barrier layer 52 or a part of the substrate 50 adjacent to the barrier layer 52 to form a copper-tin alloy (e.g., $Cu_6Sn_5$) 52', thereby reducing the thickness of the tin-plating layer 54. Therefore, such a heat treatment, when performed only in a specific area including the crimp surface region and excluding the electric contact surface region (e.g., the rear region 30*b* of the metal strip 30 illustrated in FIG. 2), enables the thickness of the tin-plating layer in the crimp surface region to be smaller than that in the electric contact surface region.

The heat treatment step involves a heating condition which can be appropriately set to an extent capable of reducing the thickness of tin-plating layer. Typically, the heating is preferably performed, at a temperature of about 200° C. to 600° C., for 3 to 60 seconds. Also heating means is not particularly limited; may be used a burner, an electric heater, hot air, infrared rays, laser or the like.

Figure 6:
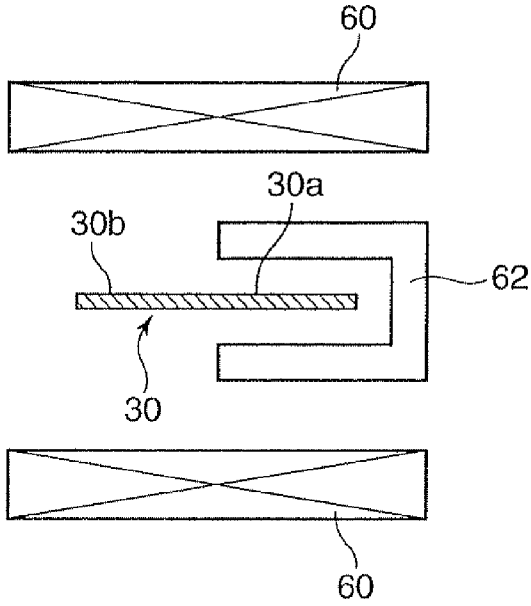
FIG. 6 is a diagram showing one example of a heating unit for use in the heat treatment step.

Heating only a specific region can be realized by masking the other region. FIG. 6 shows one example of heating units therefore. This heating unit comprises a pair of heating sources (e.g., burners or electric heaters) 60 arranged in an upward-downward direction, and a masking member 62 disposed between the heating sources 60, allowing the metal strip 30 to pass through between the heat sources 60 in a given direction (in a depth direction of FIG. 6). The masking member 62 has a shape of becoming interposed between the front region 30*a* of the metal strip 30 and each of the heating sources 60 when the metal strip 30 will pass through. This masking makes it possible to locally heat only the rear region 30*b*.

The heat treatment is permitted to be continued until the tin-plating layer in the crimp surface region is vanished. Although this causes the crimp surface to include an exposed portion of the plate body, the exposed portion is formed of a copper-tin alloy made by the solid solution of tin with the plate body; therefore, the exposed portion is unlikely to allow an oxide film to be formed therein, as compared with the case where a copper alloy forming the plate body is simply exposed.

The plating step and the heat treatment step, though performed before forming the crimp terminal from the metal plate in the method A and B, may be performed during or after the terminal forming step. For example, before an original terminal plate punched out from a metal plate formed only of the plate body as shown in FIG. 2 is subjected to bending, the original terminal plate may be subjected to plating in the plating step or heating in the heat treatment step. Alternatively, the plating step or the heat treatment step may be performed onto a terminal which has been already formed from the original terminal plate into a final terminal shape. However, it is effective for easy performance of the above steps to perform the plating step or the heat treatment step in a stage before punching out the original terminal plates from the metal strip, i.e., in a stage where the plate body of the metal plate is a simple flat plate, like the method A or B.

EXAMPLES

As for an inventive example and a comparative example, there was carried out a test for measuring a fixed strength and a contact resistance. The comparative example provides a crimp terminal, which has a structure equivalent to that of the crimp terminal 10 shown in FIG. 1, formed of a metal plate constituted by a plate body made of brass and a tin-plating layer laminated on the surface of the plate body with a thickness of 0.8 to 1.5 μm. Differently, the inventive example provides a crimp terminal where the thickness of the tin-plating layer in the crimp surface region was reduced to about 0.3 μm by a local heat treatment at 150° C.

Figure 7:
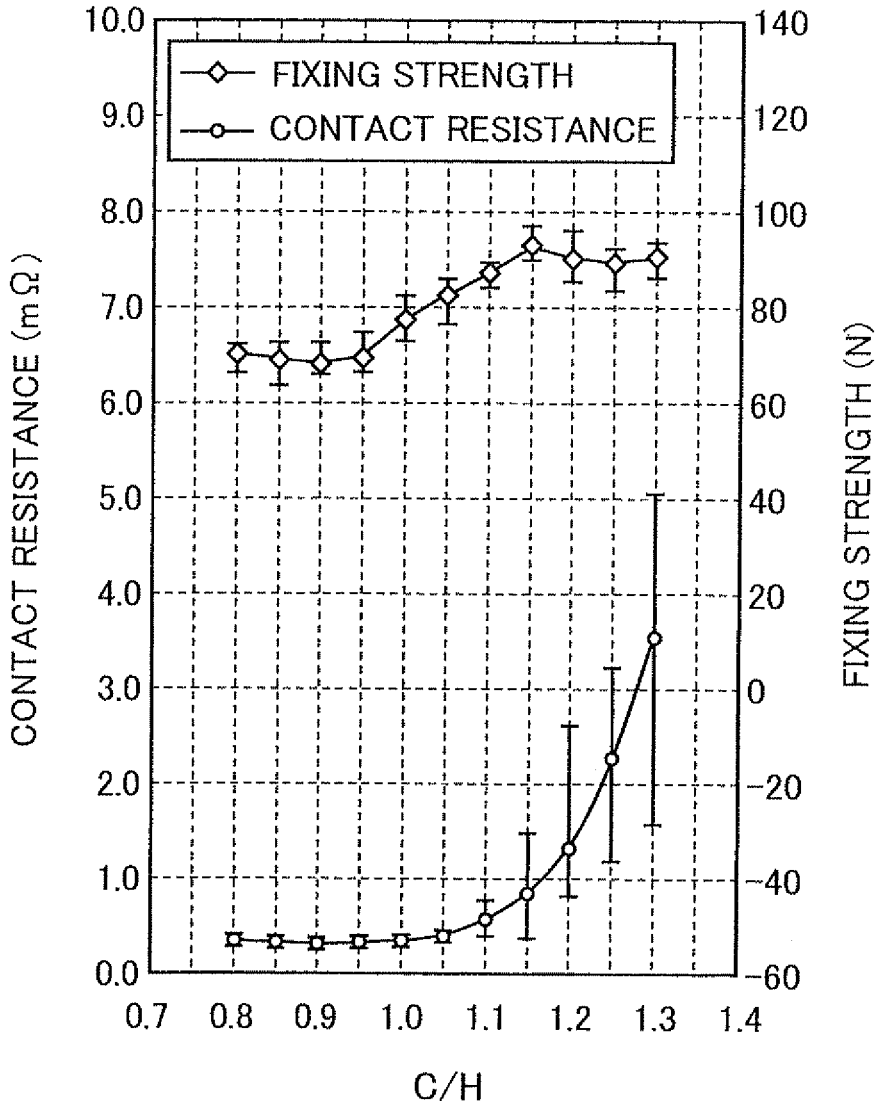
FIG. 7 is a graph showing a result of a measurement on a relationship between respective ones of a clamp height, a fixing strength and a contact resistance, in a comparative example.
Figure 8:
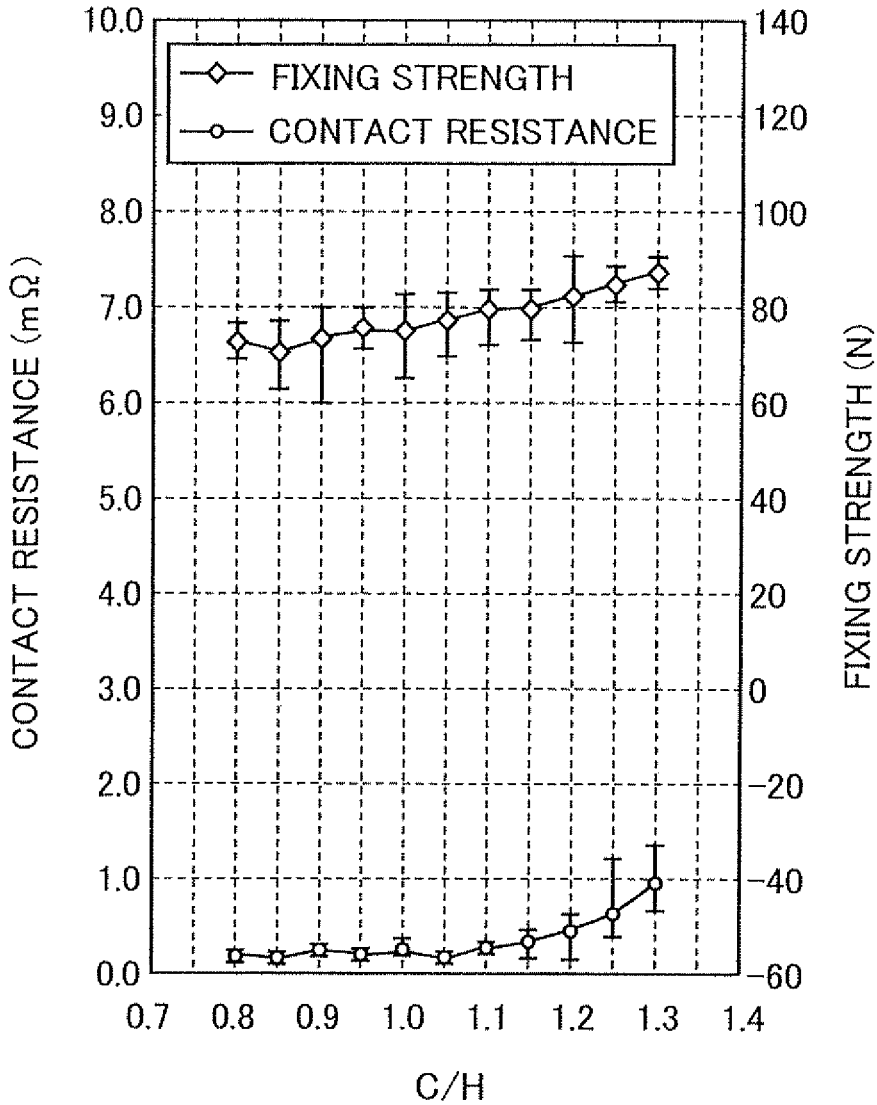
FIG. 8 is a graph showing a result of a measurement on a relationship between respective ones of the clamp height, the fixing strength and the contact resistance, in an example of the present invention.

FIGS. 7 and 8 show respective measurement results of the comparative example and the inventive example. These show respective graphs, each of which includes a horizontal axis representing a clamp height (crimp height) of the conductor barrels, and vertical axes indicate a fixed strength (which is a force by which the conductor barrels are fixed to the end portion of the electric wire) and a contact resistance in the electric-wire crimp section respectively.

In the comparative example, as shown in FIG. 7, observed is an significant increase of the contact resistance in the case of the clamp height of 1.1 or more; the contact resistance is increased to 3 mΩ or more when the clamp height is 1.3. In contrast, in the inventive example, as shown in FIG. 8, the contact resistance can be reduced to low values, even in the case of the clamp height of 1.1 or more, while the fixed strength is maintained equal to or greater than that in the comparative example; furthermore, the contact resistance can be reduced to about 1 mΩ even in the case of the clamp height of 1.3.

The present invention thus provides: a crimp terminal capable of achieving both of ensuring mechanical strength of a terminal-equipped electric wire and reducing a contact resistance between an electric wire and the crimp terminal, without providing a significant stepped portion in an electric-wire crimp section; a terminal-equipped electric wire having the crimp terminal; and methods for producing them.

The crimp terminal according to the present invention comprises an electric contact section to be fitted with a counterpart terminal to be electrically connected thereto and an electric-wire crimp section to be crimped onto an end portion of an electric wire having a conductor exposed in the end portion, the crimp terminal being formed of a metal plate having a copper-containing plate body and a tin-plating layer covering a surface of the plate body. In this crimp terminal, the tin-plating layer has a smaller thickness in a crimp surface region where the electric-wire crimp section is to make contact with the end portion of the electric wire than a thickness in an electrical contact surface region where the electric contact section is to make contact with a counterpart terminal.

In the electric contact section of the crimp terminal, the existence of the tin-plating layer in the electric contact surface region makes it possible to ensure adequate electric contact with the counterpart terminal as with a conventional crimp terminal, while, in the electric-wire crimp section, the thickness of the tin-plating layer in the crimp surface region smaller than the thickness in the electric contact surface region makes it possible to provide good adhesion between the crimp surface and the conductor of the electric wire so as to reduce a contact resistance therebetween, as compared with a conventional crimp terminal where the thickness of the tin-plating layer in the crimp surface region is equal to that in the electric contact surface region. In short, the contact resistance is allowed to be maintained at a low level not involving an increase in a deformation degree for crimp of the electric-wire crimp section (for example, without lowering a crimp height of a conductor barrel).

The preferable thickness of the tin-plating layer in the crimp surface region is, though depending on the specification thereof, in the range of 0.1 to 1.0 μm, for example. Forming so extremely thin a tin-plating layer can prevent the electric-wire crimp section from being formed with a copper oxide film, and effectively suppress an increase in the contact resistance (between the electric-wire crimp section and the conductor) due to the slippage between the tin-plating layer and the conductor of the electric wire.

The crimp surface may, alternatively, include a region where the tin-plating layer is absent to expose the plate body. Even if there exists a part where the plate body is thus exposed, the plate body can be suppressed to be formed with an oxide film, if formed, for example, of an alloy of copper (contained in the plate body) and tin (comprised in the tin-plating layer), as compared with the case where the exposed part is formed of cupper or cupper alloy.

The method for producing the above crimp terminal according to the present invention comprises: a terminal forming step of forming a terminal having the electric contact section and the electric-wire crimp section from a metal plate having a copper-containing plate body; and a plating step of forming a tin-plating layer on a surface of the plate body, at one timing of before, during and after the terminal forming step, the plating step including a first plating sub-step of forming a tin-plating layer over an entire surface of the plate body, and a second plating sub-step of forming a tin-plating layer on the plate body in an area thereof, before or after the first plating sub-step, the area including the electric contact surface region and excluding the crimp surface region.

In this method, a combination of the first plating sub-step and the second plating sub-step allows the thickness of the tin-plating layer to be given a difference between the crimp surface region and the electric contact surface region.

Alternatively, the plating step may include a first plating sub-step of forming a tin-plating layer on the plate body of the metal plate in an area thereof including the electric contact surface and excluding the crimp surface, and a second plating sub-step of forming a tin-plating layer having a thickness smaller than that of the tin-plating layer formed or to be formed in the first plating sub-step, before or after the first plating sub-step, on the plate body in an area thereof including the crimp surface and excluding the electric contact surface.

While the plating step may be performed during the terminal forming step (e.g., just after punching-out from the metal plate by a press) or after the terminal forming step, more preferable is that the plating step is performed before the terminal forming step to form a metal plate having the plate body and the tin-plating layer and the terminal forming step is performed by use of the tin-plating layer-formed metal plate. This method allows a tin-plating layer to be easily formed on a surface of the plate body of the metal plate having a simple plate shape.

Besides, the present invention also provides a method for producing the above crimp terminal, the method comprising: a terminal forming step of forming a terminal having the electric contact section and the electric-wire crimp section, by use of a metal plate having a copper-containing plate body; a plating step of forming a tin-plating layer, at one timing of before, during and after the terminal forming step, on a surface of the plate body of the metal plate; and a heat treatment step of heating only a region of the tin-plating layer-formed metal plate, the area including the crimp surface and excluding the electric contact surface, so as to bring at least a part of the tin-plating layer into a solid solution with copper contained in the plate body to reduce a thickness of the tin-plating layer.

According to this method, even if the thickness of the tin-plating layer after the plating step is approximately even all over, the subsequent local heat treatment for the crimp surface region brings the tin-plating layer in the crimp surface region into a solid solution with copper contained in the plate body underneath the tin-plating layer, thus allowing the thickness of the tin-plating layer in the crimp surface region to be small than that in the electric contact surface region. Furthermore, it is also possible to vanish the tin-plating layer in the crimp surface region to expose a portion where the tin and copper contained in the plate body have been brought into a solid solution (i.e. an alloy portion).

Also in this method, it is preferable that the plating step and the heat treatment step are performed before the terminal forming step to form a metal plate having the plate body and the tin-plating layer and the terminal forming step is performed by use of the tin-plating layer-formed metal plate.

The present invention also provides a terminal-equipped electric wire which comprises an electric wire having a conductor exposed in an end portion thereof, and the above crimp terminal, the electric-wire crimp section of which is crimped onto the conductor in the end portion of the electric wire. In this terminal-equipped electric wire, the tin-plating layer in the electric contact section of the crimp terminal provides adequate electric contact between the electric contact section and the counterpart terminal, and the suppressed thickness of the tin-plating layer in the crimp surface region of the electric-wire crimp section of the crimp terminal allows the contact resistance between the electric-wire crimp section and the conductor of the electric wire to be reduced.

Besides, the present invention provides a method for producing a terminal-equipped electric wire which comprises an electric wire having a conductor exposed in an end portion thereof and a crimp terminal crimped onto the end portion, the method comprising a terminal forming step of forming the above crimp terminal, and a crimp step of placing the conductor in the end portion of the electric wire onto the electric-wire crimp section of the crimp terminal and plastically deforming the electric-wire crimp section to crimp the crimp surface region of the electric-wire crimp section onto a surface of the conductor.

The above-mentioned terminal-equipped electric wire and the production method therefore are effective, particularly, in the case that the conductor of the electric wire be made of aluminum or an aluminum alloy.

What is claimed is:

1. A crimp terminal designed to be crimped onto an end portion of an electric wire having a conductor exposed in the end portion, comprising:

an electric contact section to be fitted with a counterpart terminal to be electrically connected thereto, the electric contact section including an electrical contact surface region where the electric contact section is to make contact with a counterpart terminal; and an electric-wire crimp section to be crimped onto the end portion, the electric-wire crimp section including a crimp surface region where the electric-wire crimp section is to make contact with the end portion of the electric wire, the crimp terminal being formed of a metal plate which has a copper-containing plate body and a tin-plating layer covering at least a part of a surface of the plate body, the whole of the crimp surface region of the tin-plating layer having a smaller thickness than a thickness of the tin-plating layer in the whole of the electrical contact surface region, the electrical contact surface region being covered with two tin-plating layers and the crimp surface region being covered with one tin-plating layer.

2. The crimp terminal as defined in claim 1, wherein the thickness of the tin-plating layer in the crimp surface region is in the range of 0.1 to 1.0 μm.

3. The crimp terminal as defined in claim 1, wherein the crimp surface region includes a region where the thickness of the tin-plating layer is zero, which results in an exposed plate body part, the exposed plate body part being made of a copper-tin based alloy.

4. A method for producing the crimp terminal as defined in claim 1, comprising:

a terminal forming step of forming a terminal having the electric contact section and the electric-wire crimp section, by use of a metal plate having a copper-containing plate body; and a plating step of forming a tin-plating layer on a surface of the plate body, at one timing of before, during and after the terminal forming step, the plating step including a first plating sub-step of forming a tin-plating layer over an entire surface of the plate body, and a second plating sub-step of forming a tin-plating layer on the plate body in only an area thereof, before or after the first plating sub-step, the area including the electric contact surface region and excluding the crimp surface region.

5. The method as defined in claim 4, wherein the plating step is performed before the terminal forming step to form a metal plate having the plate body and the tin-plating layer, and wherein the terminal forming step is performed by use of the tin-plating layer-formed metal plate.

6. A method for producing the crimp terminal as defined in claim 1, comprising:

a terminal forming step of forming a terminal having the electric contact section and the electric-wire crimp section, by use of a metal plate having a copper-containing plate body; and a plating step of forming a tin-plating layer on a surface of the plate body of the metal plate, at one timing of before, during and after the terminal forming step, the plating step including a first plating sub-step of forming a tin-plating layer on the plate body of the metal plate in only an area thereof including the electric contact surface region and excluding the crimp surface region, and a second plating sub-step of forming a tin-plating layer having a smaller thickness than that of the tin-plating layer formed or to be formed in the first plating sub-step, before or after the first plating sub-step, on the plate body only in an area thereof including the crimp surface region and excluding the electric contact surface region.

7. The method as defined in claim 6, wherein the plating step is performed before the terminal forming step to form a metal plate having the plate body and the tin-plating layer, and wherein the terminal forming step is performed by use of the tin-plating layer-formed metal plate.

8. A method for producing the crimp terminal as defined in claim 1, comprising:

a terminal forming step of forming a terminal having the electric contact section and the electric-wire crimp section, by use of a metal plate having a copper-containing plate body;

a plating step of forming a tin-plating layer, at one timing of before, during and after the terminal forming step, on a surface of the plate body of the metal plate; and a heat treatment step of heating only a heating-target region of the tin-plating layer-formed metal plate, the heating-target region including the crimp surface region and excluding the electric contact surface region, so as to bring at least a part of the tin-plating layer into a solid solution with copper contained in the plate body to reduce a thickness of the tin-plating layer.

9. The method as defined in claim 8, wherein the plating step and the heat treatment step are performed before the terminal forming step to form a metal plate having the plate body and the tin-plating layer, and wherein the terminal forming step is performed by use of the tin-plating layer-formed metal plate.

10. A terminal-equipped electric wire comprising: an electric wire having a conductor exposed in an end portion thereof; and the crimp terminal as defined in claim 1, the electric-wire crimp section of the crimp terminal being crimped onto the conductor in the end portion of the electric wire.

11. The terminal-equipped electric wire as defined in claim 10, wherein the conductor of the electric wire is made of aluminum or an aluminum alloy.

12. A method for producing a terminal-equipped electric wire which comprises an electric wire having a conductor exposed in an end portion thereof and a crimp terminal crimped onto the end portion, the method comprising a step of producing the crimp terminal as defined in claim 1, and a step of placing the conductor in the end portion of the electric wire on the electric-wire crimp section of the crimp terminal and plastically deforming the electric-wire crimp section to crimp the crimp surface of the electric-wire crimp section onto a surface of the conductor.

13. The method as defined in claim 12, wherein the conductor of the electric wire is made of aluminum or an aluminum alloy.

* * * * *